US008475229B2

(12) United States Patent
Himmelsbach

(10) Patent No.: US 8,475,229 B2
(45) **Date of Patent: *Jul. 2, 2013**

(54) METHOD AND GRINDING MACHINE FOR THE COMPLETE GRINDING OF SHORT AND/OR ROD-SHAPED WORKPIECES

(75) Inventor: Georg Himmelsbach, Haslach (DE)

(73) Assignee: Erwin Junker Maschinenfabrik GmbH, Nordrach (DE)

( * ) Notice: Subject to any disclaimer, the term of this patent is extended or adjusted under 35 U.S.C. 154(b) by 171 days.

This patent is subject to a terminal disclaimer.

(21) Appl. No.: 12/532,314

(22) PCT Filed: May 8, 2008

(86) PCT No.: PCT/EP2008/055693

§ 371 (c)(1),
(2), (4) Date: Sep. 21, 2009

(87) PCT Pub. No.: WO2009/100771

PCT Pub. Date: Aug. 20, 2009

(65) Prior Publication Data

US 2011/0195635 A1 Aug. 11, 2011

(30) Foreign Application Priority Data

Feb. 14, 2008 (DE) ..... 10 2008 009 124

(51) Int. Cl.
*B24B 49/00* (2006.01)

(52) U.S. Cl.
USPC ..... 451/11; 451/49; 451/262; 451/409

(58) Field of Classification Search
USPC ..... 451/11, 49, 401, 262, 265
See application file for complete search history.

(56) References Cited

U.S. PATENT DOCUMENTS

| | | | | |
|---|---|---|---|---|
| 1,926,974 | A | 9/1933 | Einstein | |
| 2,166,461 | A * | 7/1939 | Carlson | 451/401 |
| 3,859,756 | A * | 1/1975 | Zerbola | 451/49 |
| 6,080,045 | A * | 6/2000 | Pruitt et al. | 451/49 |
| 6,220,939 | B1 * | 4/2001 | Pruitt | 451/49 |
| 6,319,097 | B1 * | 11/2001 | Coverdale et al. | 451/49 |
| 6,431,954 | B1 | 8/2002 | Junker | |
| 7,147,547 | B2 * | 12/2006 | Junker | 451/57 |
| 7,189,144 | B2 * | 3/2007 | Kamamura et al. | 451/11 |
| 7,607,969 | B2 * | 10/2009 | Miura et al. | 451/11 |
| 7,901,269 | B2 * | 3/2011 | Miura et al. | 451/11 |

(Continued)

FOREIGN PATENT DOCUMENTS

| | | |
|---|---|---|
| DE | 197 56 610 | 7/1999 |
| DE | 10 2006 007 055 | 8/2007 |

(Continued)

*Primary Examiner* — Maurina Rachuba
(74) *Attorney, Agent, or Firm* — Jordan and Hamburg LLP

(57) ABSTRACT

Short and/or rod-shaped workpieces are completely machined by grinding two parallel end faces and the longitudinal sides of the workpiece with very short cycle times. The grinding machine includes two grinding spindles that are arranged in a tandem arrangement with parallel rotational axes on a shared grinding headstock and that are jointly moved in the X direction. In cooperation with a special holding and transport device for the workpieces, two workpieces are each ground, at least partly concurrently, the end faces of the one workpiece being ground in one machining position and the final non-circular grinding of the exterior contour of a second workpiece occurring in a second machining station, the end faces of the second workpiece having already been ground.

26 Claims, 10 Drawing Sheets

U.S. PATENT DOCUMENTS

| | | | | |
|---|---|---|---|---|
| 2005/0079799 | A1* | 4/2005 | Montandon et al. | 451/11 |
| 2005/0255793 | A1* | 11/2005 | Junker | 451/11 |
| 2010/0167628 | A1 | 7/2010 | Himmelsbach et al. | |

FOREIGN PATENT DOCUMENTS

| | | |
|---|---|---|
| EP | 0 522 272 | 1/1993 |
| JP | 60-24520 | 2/1985 |
| JP | 61-144467 | 9/1986 |
| JP | 5-212617 | 8/1993 |
| JP | 5-337797 | 12/1993 |
| JP | 3881260 | 2/2007 |
| WO | WO-2007/093345 | 8/2007 |

* cited by examiner 14
6
41
14c
1'
2
24a
15
A
24a
C
1
15a
6b
24a
42

14
6
41
14c
24a
1'
24a
42
15
A
24a
C
1
6b
15a
24a

METHOD AND GRINDING MACHINE FOR THE COMPLETE GRINDING OF SHORT AND/OR ROD-SHAPED WORKPIECES

BACKGROUND OF THE INVENTION

The invention relates to a method and a grinding machine for the complete grinding of short and/or rod-shaped workpieces that have a non-circular cross-section that is formed by straight and/or curved lines and that have flat end faces that run parallel to one another and relates to a grinding machine in which two grinding spindles are arranged in tandem and that is particularly suitable for performing the method.

The phrase "short and/or rod-shaped workpieces" means that the only workpieces intended are those that do not require machining with an adjustment of the grinding wheel in the Z direction, e.g. the longitudinal direction of the workpiece, or that require only a minor adjustment in the Z direction, perhaps for producing a bevel in the area of the end faces. Thus the grinding wheels are positioned only in the X direction that is perpendicular thereto. In any case, the workpieces have two end faces that are parallel to one another and one exterior contour that is preferably perpendicular thereto and has the length "L", it being possible for the length "L" to be greater or smaller than the effective diameter of the end face. Thus both rod-shaped and disk-shaped workpieces are included and they can have any desired cross-section/exterior contour. "Rod-shaped workpiece" shall be used in the following for the sake of brevity, disk-shaped workpieces also being included.

One preferred exemplary application for such short, rod-shaped workpieces is mechanical positioning, switching, and control devices in which rod-shaped parts are actuators that transfer movements and forces. In this case, the rod-shaped workpieces can have a length between preferably 10 and 80 mm and a square cross-section with an edge length between preferably 2 and 15 mm. The material can be different metals, but can also be ceramic materials. With appropriate guidance, the non-circular cross-section means that when installed the rod-shaped actuators will move only in their longitudinal direction, but will not turn.

In this type of application, very high demands are placed on the finish-ground rod-shaped workpiece; primary among these are the dimensional accuracy of the basic dimensions, the end faces being parallel, maintaining precisely the right angle between the longitudinal sides and the end faces, the planarity of the end faces, and the maximum roughness Rz.

The accuracy required in specific applications can be attained in that each side of the rod-shaped workpiece is machined individually using horizontal surface grinding. However, this method is limited to geometric cross-sections that have straight edges. In this grinding method, it is very difficult to supply the grinding zone with cooling lubricant due to the surface contact with the grinding wheel. For this reason it is not possible to attain the same material removal rate as with circumferential grinding. In addition, the workpiece must be indexed and reclamped so frequently that economic mass production is not possible. Because of the indexing and reclamping of the workpiece, the tight production tolerances cannot be attained as they can be using the inventive method.

DE 10 2006 007 055 A1 describes a method and a device for machining such workpieces, in which method the workpiece is initially held on its circumference and supplied to a grinding station. Both end faces are simultaneously rough-ground and fine ground there by means of a double wheel. With the double wheel, two coaxial, rotating grinding wheels that are arranged spaced apart from one another grip the workpiece. The grinding wheels have abrasive layers on the interior sides that face one another for rough-cutting and subsequent finish-cutting, and these layers engage one after the other by moving the grinding spindle in the depth direction (X axis). The distance between the finish-cut areas of the grinding wheels is equal to the grinding amount for the workpiece to be machined. Once the end faces have been machined, the workpiece is transferred to a second clamping in which it is clamped by its end faces. Now the exterior contours of the workpiece are produced using non-circular grinding, to which end a second grinding spindle is pivoted into the machining position. The first grinding spindle for the double grinding, which is seated on the same pivotable housing as the second grinding spindle, is pivoted out of the machining area. Once the exterior contour has been machined, the finish-machined workpiece is removed and the next workpiece is moved into position for double grinding the end faces, for which purpose the first grinding spindle must be pivoted back and re-positioned.

In practice it has been found that alternately pivoting and moving the two grinding spindles into the machining position requires a significant amount of time, and no workpieces can be machined during this period. System productivity suffers because of this, which is a major disadvantage, particularly with respect to the generally very large number of workpieces to be produced. The time that cannot be used for grinding and the time in which it is not possible to perform at least some time-parallel grinding can amount to 30% to 50% of the entire machining time for one workpiece.

SUMMARY OF THE INVENTION

The underlying object of the invention is therefore to design the method and the grinding machine of the type cited in the foregoing such that it is possible to reduce the cycle time and thus to improve economic mass production in conjunction with a very good grinding result.

With the inventive method, the complete machining of the rod-shaped workpiece is performed in two partial processes in a manner such that the complete machining can be performed on a single grinding machine in one continuous production process. Two different clamped positions or clampings occur that cycle into one another. First each workpiece is clamped individually on its longitudinal sides, that is, not for instance in the profiled recess of a cam disk, in one of a plurality of clamping devices of a movable holding device—this is the first clamped position. The clamping devices are preferably embodied as loading grippers that have two jaws that can move towards and away from one another and between which the workpiece can be fixed by clamping the lateral surfaces. The sides that come into contact with the workpiece preferably conform to the exterior shape of a workpiece blank in order to hold it securely for transport by the grinding machine and for machining. The loading grippers are dimensioned such that both end faces of the workpiece project laterally from it so that there is no obstacle to machining them. They must also be shaped such that they are able to take finish-ground workpieces and hold them for transport to an unloading site.

During this clamping, the workpiece is transferred to a first machining area in which the two end faces are at least finish-ground. As a rule the end faces are rough-ground and finish-ground in this clamping. However, separate rough-grinding is not always necessary at this location. If the clamping device is appropriately configured, the double face grinding leads to an excellent result on the end faces. The workpiece, which is still clamped, that is, which is still in the first clamped position, is then transferred by means of a movement by this clamping device between two coaxial jaws disposed at a distance from one another and clamped by them on its end faces, which are already finish-ground and thus provide the best conditions for precise further machining. Strict attention must be paid that during the re-clamping the workpiece is not displaced longitudinally, thus changing its position from the required target position in relation to the position of the second grinding wheel. Having the clamping jaws with which the workpiece is clamped on its end faces perform the movements and selecting clamping forces for the loading grippers that provide the clamping for the first machining ensures that the workpiece is not displaced longitudinally when clamped on its end faces with the clamping jaws for the workpiece headstocks.

The clamping jaws effect the second clamped position for the rod-shaped workpiece; the first clamped position is now released. Because the two clamping jaws are turned synchronously and in-phase in a controlled manner, CNC-controlled circumferential grinding can be performed using the C-X interpolation principle. Each turning position of the workpiece caused to turn by the two clamping jaws (axis of rotation C) corresponds to a certain spacing of the grinding wheel in the direction of the X axis. The details in this regard are familiar to one skilled in the art in the field CNC-controlled non-circular grinding and therefore do not require more detailed description.

In contrast to face grinding, if the rod-shaped workpiece is machined using the principle of non-circular grinding, there is a contact line between the grinding wheel and the workpiece. The supply of coolant is improved because of this, and a higher material removal rate is attained so that the machining time is reduced significantly.

With CNC-controlled circumferential grinding it is possible to rough-grind and finish-grind rod-shaped workpieces having different cross-section, that is, simple square or rectangular cross-sections with rounded longitudinal edges or flat bevels on the longitudinal edges all the way to prismatic cross-section or even cross-sections having different curved limiting lines all the way to mixes of all of these. The simple option of grinding flat longitudinal sides with broken or rounded edges all at once, but also cross-sections with continuously curved contours, prevents the problem of burr formation as a result of face grinding. A number of the options are depicted in FIG. 1 of the exemplary embodiment.

If the circumferential grinding uses a profiled grinding wheel that covers the entire length of the rod-shaped workpiece, the longitudinal contour of the workpiece can also be configured differently. Examples of this are depicted in FIG. 2 of the exemplary embodiment. End-face bevels and rounding are among these different longitudinal contours.

When the clamping jaws move apart from one another after the finish-grinding, the second clamped position is released and the finished rod-shaped workpiece is again clamped and held in the holding device by the clamping jaws from the first clamping. The holding device is cycled further, i.e. by an angle $\alpha$ that is determined by the number of clamping devices (at least 3, preferably 4, 5, or 6), and brings the finished workpiece into an unloading position, where it is transferred to an unloading device.

Because two machining processes are performed successively on one workpiece, it only being necessary to move the two grinding wheels short distances in the X direction and away from the workpiece, a significant amount of time is saved compared to the machining described in accordance with DE 10 2006 007 055 A1. This time savings can be more than 30% to 50% of the entire cycle time for the machining of one workpiece. Time is saved simply because the relatively long periods of time for pivoting the grinding wheels into and out of the machining area are completely unnecessary because in accordance with the invention both grinding spindles are always in a tandem arrangement in the immediate vicinity of the associated machining area. The grinding spindles and grinding wheels arranged together on one headstock perform only one movement in the X direction within a very limited area. Instead of complicated pivoting of the grinding spindles in accordance with the prior art, the workpiece merely has to be transported from a first machining position having a first grinding wheel to a second machining position having a second grinding wheel, which can happen very rapidly. In addition, a plurality of workpieces can be clamped on the holding device and cycled through the machining area simultaneously. Of these workpieces, two are machined in each movement cycle of the holding device, the one in the first machining position undergoing finish machining of two end faces and another part being finish-ground in a second machining position. This accelerates throughput noticeably.

Further acceleration can be attained in that both workpieces in the machining positions are ground concurrently, at least intermittently, which is possible with nothing further for certain exterior workpiece contours. At least concurrent machining of two workpieces is attainable for brief time segments in the machining cycle, for instance such that the finish-grinding of the end faces in the first machining position overlaps temporally the beginning of the non-circular grinding in the second machining position. These essential advantages relative to the prior art result particularly due to the tandem arrangement of the two grinding spindles on one grinding headstock, which can also be attained when using different transport and clamping devices than those described herein.

In the first grinding process, the double face grinding of the end faces, the workpiece clamped in the holding device is advanced to the first grinding wheel, which, as a "double grinding wheel", can constitute two individual grinding wheels, and this movement is accomplished by turning the holding device about a pre-determined angle $\alpha$. The face grinding process itself occurs by moving the first grinding wheel, which is borne in a normal manner on a first grinding spindle. For machining, the rotating first grinding wheel, the double grinding wheel, can be moved in the direction of the X axis. During the grinding process, the two grinding wheels in the double grinding wheel act on the rod-shaped workpiece, the longitudinal aspect of which runs parallel to the rotational axis of the first grinding wheel. In the following the terms "first grinding wheels", "first grinding wheel", and "double grinding wheel" are used synonymously, because the only thing that matters is that the grinding wheel in question has two abrasive surfaces with which it is possible to grind both end faces of the workpiece simultaneously. This also applies to the claims.

Alternatively, the workpiece end faces can also be double face ground in that the holding device carrying the clamped workpiece is moved relative to the first grinding wheel, the double grinding wheel, in the sense of being positioned. This movement occurs if there is a turnable holding device, e.g. in the form of a timing disk, preferably as rotation. Naturally the movement can also be realized as a linear displacement of the holding device. This variant of the inventive method enables even more time to be gained for the machining cycle, because two workpieces can be ground practically concurrently. To this end a workpiece, the end faces of which have already been machined, is moved by the holding device into the second machining position and there it is taken by the second clamping device, whereupon the clamping jaws previously holding it are moved apart from one another. Thus it has no more contact with the holding device and, caused to rotate by the second clamping device, can be ground on its lateral surfaces. This decoupling of the workpiece in question from the holding device makes it possible to move the holding device, which carries another workpiece, the end faces of which are to be machined, such that the additional workpiece travels into the grinding area of the first grinding wheel and is finish-ground by it. In this modification of the method, this double face grinding essentially occurs concurrently with the non-circular grinding of the exterior contour of the first aforesaid workpiece. If the two grinding wheels are arranged in a tandem arrangement on a shared grinding headstock according to one particularly preferred embodiment, the necessary result is that the first grinding wheel follows the movement of the second grinding wheel during non-circular grinding. However, this is of no significance for the double face grinding in accordance with the described method variant because the movement is only minor and the movement is very slow compared to the rotational speed of the first grinding wheel. The grinding result for the first grinding wheel is not negatively affected by this.

However, the method at this location can also be conducted such that the workpiece remains locationally fixed at its position and the first grinding wheel can be moved longitudinally and transversely to the workpiece. The method with the grinding wheel in the longitudinal direction is preferably for adjusting the grinding wheels with respect to the workpiece or with respect to the position of the second grinding wheel for machining the exterior contour.

An advantageous option for how the first, face grinding process can transition to the second, circumferential (i.e., peripheral) grinding process is to bear the first grinding wheel on the one hand and at least one second grinding wheel on the other hand, with the associated grinding spindles, on a shared grinding headstock that can be moved in the X direction. By pivoting the holding device, the individual workpieces are successively first moved to the active area for the first grinding wheel and then to that of the second grinding wheel. For the positioning movement in the X axis that is required during grinding, the shared grinding headstock is moved in a controlled manner in the direction of the X axis.

When the clamping jaws are moved apart from one another after the finish-grinding, the second clamped position is released and the finished rod-shaped workpiece is again transferred to the holding device. The latter turns in the next work cycle, moving the workpiece to the unloading position, where it can be taken by an unloading device.

Sensors are advantageously integrated in the loading grippers of the holding device, and they can be used to determine the grinding allowance for the individually clamped workpieces. The values obtained in this manner are transmitted to the control device for the grinding machine and the latter factors them in when determining how to perform the circumferential grinding. This can also result in accelerating the machining.

Because during non-circular grinding of the exterior contour of workpieces significant pressures can occur transverse to the longitudinal axis of the workpiece and the forces lead to the workpiece bending, the inventive method also includes provision of a steady for supporting the workpiece against bending from transverse forces. These steadies, of which one is associated with each loading gripper, i.e. clamped position for the workpiece, are mounted on the holding device together with the loading grippers. The steadies can be positioned on the holding device in relation to the position of the workpiece or they can be removed from this position and can be used only in the second machining position for grinding the exterior contour with the second grinding wheel. Their use is as follows: After the workpiece in the second machining position is taken and clamped by the clamping jaws, the jaws of the loading gripper are opened so that the workpiece can rotate freely and the second grinding wheel has clearance for machining. In this condition first the lateral edges of the workpiece are circular ground to the finished dimensions, which means that the largest diameters of the finished workpiece are determined. Then the steady is moved toward the workpiece until the steady is positioned against at least one point on the workpiece and thus supports the latter against transverse forces. The steady is preferably moved using hydraulic or pneumatic means that one skilled in the art is familiar with. On its side that engages with the workpiece the steady preferably has a recess that is semi-circular in cross-section and that conforms to the aforesaid diameter of the finished workpiece. What this attains is that when the workpiece rotates in the steady at least one area on the circumference of the workpiece is in contact with the steady so that the latter can provide support in every phase of the rotation. Once the steady is positioned, the finish machining of the exterior surfaces of the workpiece is performed, and thus the machining is completed. Then the steady is removed from the workpiece, the loading grippers of the holding device again grip and clamp the workpiece, and then the clamping jaws of the workpiece headstocks are moved apart from one another and are released for transport by the holding device. Now there is a new work cycle and the holding device is again turned by the angle $\alpha$, so that the finished workpiece is removed from the second machining area and is finally moved to an unloading device. The latter may not be reached until additional work cycles have been completed, depending on the number of clamped positions on the holding device and the arrangement of the unloading station with respect to the holding device.

According to a variant of this method, the lateral edges are only ground approximately to the finished dimensions. "Approximately" shall be understood to mean that only a few hundredths of a millimeter, about 1 to 3 hundredths of a millimeter, must be ground off to attain the final dimensions. As described hereinabove, the steady is then placed against the workpiece and the latter is likewise ground approximately to the finished dimensions. Then the steady is removed and the entire exterior contour is ground to the finished dimensions. Since only very minor abrasion is necessary for this, and it requires only slight grinding pressure, there is no negative effect on the accuracy of the grinding.

In the following there is also the option for controlling the steady such that it does not have to be withdrawn in order to finish-grind the rest and the workpiece then remains supported until it has attained its final dimensions.

By using the steady, it is possible not only to attain increased accuracies with long, thin workpieces, but also a greater cutting volume can be machined per unit of time, which again reduces the grinding time for the workpiece.

The methods utilizing a steady as described hereinabove are especially suitable for workpiece cross-section shapes that are depicted in FIG. 1 (with the exception of FIG. 1*g*). Production precision can be significantly improved for such workpieces that have largely regular contours and cross-sections with symmetries.

One grinding machine that is suitable in particular for performing the method of the invention, including various preferred embodiments thereof; as described hereinabove is described hereinbelow.

The special aspect of this grinding machine is that two grinding spindles with parallel rotational axes are mounted on one grinding headstock in a "tandem arrangement" and can be jointly moved by means thereof The term "tandem arrangement" refers to the way in which the grinding spindle and grinding wheels are arranged and is intended to express that the grinding wheels of the two grinding spindles can machine two workpieces concurrently, at least intermittently, but only one advancing mechanism is required. This feature distinguishes this arrangement in principle from known arrangements of two grinding spindles on one grinding headstock, in which the individual grinding spindles are caused to contact a single workpiece by pivoting parts of the grinding headstock about a rotational axis. There is no time-consuming pivoting of the grinding spindles at all with the tandem arrangement. The time expended for moving the workpieces from one machining position to the other in the inventive grinding machine is minor in comparison, especially given that in the known grinding machines, for instance in accordance with DE 10 2006 007 055 A1, the workpiece must be moved into the machining position and out of it again.

In addition, the grinding machine offers the advantage that a plurality of rod-shaped workpieces can be transported and machined by the machine simultaneously, being face ground on the end faces in the first clamped position and machined on the longitudinal sides using circumferential grinding in the second clamped position. After passing through the grinding machine, the rod-shaped workpieces are finish-ground. The handling times are reduced to a minimum.

It is particularly advantageous when the holding device for the workpieces, which both clamps the workpieces and also transports them to the machining positions and through the grinding machine from a loading device to an unloading device, is embodied as a timing disk. The timing disk, preferably embodied as a circular plate, can be turned about a horizontal axis and carries clamped positions arranged in its periphery or on its outer edge, these clamped positions preferably being embodied as loading grippers having two gripper jaws that can be moved towards and away from one another. The clamped positions, of which there are at least three, while 4, 5, or 6 are preferred, are disposed at equal intervals on the circumference of the timing disk. Depending on their number, they are arranged at an angle of rotation a between them that is equal to 360° divided by the number of clamped positions. During operation, one cycle in the timing disk is one turn about the angle $\alpha$. Preferably, at least one workpiece blank is transferred from the loading position into the first machining position, a workpiece that has been finish-ground on its end faces is brought into the second machining position, and a completely finish-ground workpiece is removed from the machining area of the grinding machine.

In another embodiment of the invention, the second grinding wheel in the inventive grinding machines which conforms to the longitudinal contour of the finished rod-shaped workpiece can also include its end-face bevels. Machining the lateral workpiece surfaces with numerically controlled circumferential grinding using the C-X interpolation principle makes it possible for rounding radii or bevels to be ground on the edges together with the lateral surfaces without lengthening the cycle. This is also true for the end-face bevels if the contour of the grinding wheel is appropriately profiled. The end-face bevels are ground in the same clamping in one contour pass concurrent with the lateral surfaces and with the bevels or rounding radii running longitudinally. There is no re-clamping. The process is significantly simpler and more certain overall in terms of the required geometry data (dimensional tolerances, shape and position tolerances). Not only is machining time saved, but in particular the risk of inaccuracies associated with re-clamping is also avoided. In addition, the contour of the grinding wheels during dressing must be adjusted with an accuracy in the μm range. Thus there are end-face bevels that always have exactly the same width among one another and for their entire length. In this respect, as well, the invention improves both the speed of the machining and the accuracy of the product. Moreover, it is also possible to use profiled grinding wheels, for instance galvanically coated grinding wheels, that do not have to be dressed.

In an advantageous and preferred embodiment of the drive for the timing disk, the timing disk can be driven both in the forward direction and also in the opposite, backward direction. This makes it possible to grind substantially concurrently with both grinding wheels, each on one workpiece, which leads to a particularly short cycle time for complete machining of the workpieces, as is explained hereinbelow with reference to FIGS. 10 and 11.

The inventive grinding machine works with proven basic elements of modern grinding, which are however linked to one another in a new mariner using an intelligent delivery and clamping system. The structure of the grinding machine remains simple. The grinding machine can be loaded with a loading cell through a loading hatch so that for instance the so-called "keyhole option" is possible, in which option the workpieces are fed in. Other embodiments of delivery systems for supplying the workpieces to and removing them from the holding device are also possible.

It is also possible to produce smaller lot sizes economically using the inventive grinding machines because they are set up to perform complete machining on one specific workpiece type. Thus there is a great deal of flexibility in terms of numbers of units. In particular there is also great flexibility due to the numerically controlled circumferential grinding using the principle of C-X interpolation; tooling times when changing to a different cross-section for the rod-shaped workpieces can be very short. For instance, for a rod-shaped workpiece having a square cross-section it is possible to change from longitudinal edges broken by bevels to rounded longitudinal edges within 3 minutes because the changeover occurs only on the parts program for the workpiece to be produced. Even the bevel fits with the cross-section.

BRIEF DESCRIPTION OF THE DRAWINGS

The invention is explained in greater detail in the following using the drawings. The figures depict the following.

DETAILED DESCRIPTION OF THE INVENTION

Figure 1:
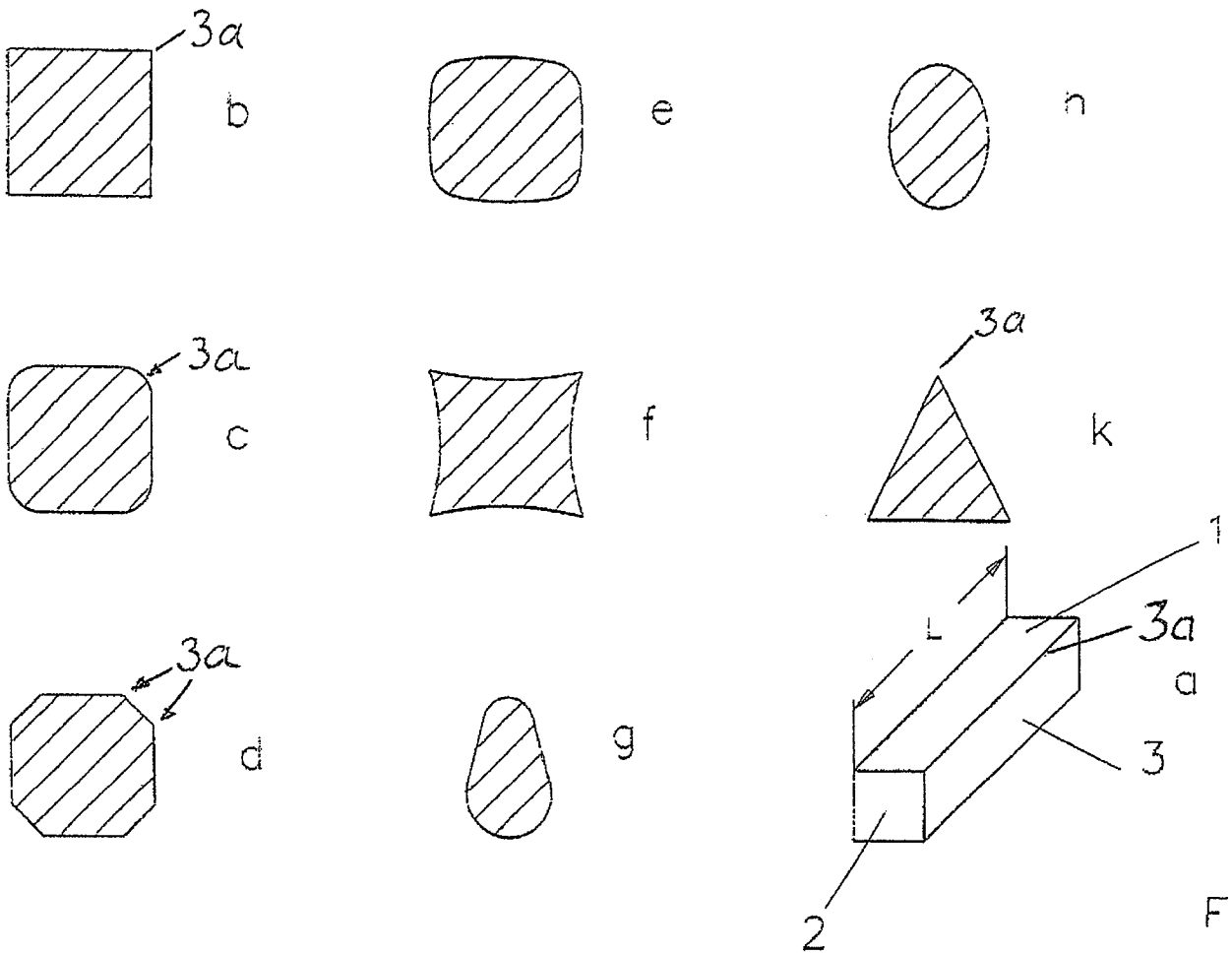
FIG. 1 illustrates various non-circular cross-sections of rod-shaped workpieces that are to be ground in accordance with the invention.

FIG. 1 provides examples of the shape that the cross-section of the rod-shaped workpiece 1 to be ground can have. In its simplest shape, the rod-shaped workpiece 1 is a block-shaped rod with square end faces 2 and rectangular longitudinal sides 3 that meet in lateral edges 3*a* (see FIGS. 1*a* through 1*d*). One preferred area of application for such rod-shaped workpieces 1 are actuators in mechanical switching or control devices. These control members can have a length L between 10 and 80 mm and a cross-section between 2 and 15 mm; however, this is only an example. Materials for such rod-shaped workpieces 1 are different metals, but also ceramic materials. Depending on the function desired, the cross-section does not have to be a strictly geometrical square (b). Thus, the longitudinal edges can be rounded (c) or provided with flat bevels (d). The square shape can also be varied to include a square with convex surfaces (e) or concave surfaces (f). Furthermore possible are contours having cross-section (g) that are limited only by curved lines, that is, oval contours (h) or polygons of any type (k) in which the cross-section is not square, either.

Nor is the longitudinal contour of the rod-shaped workpiece 1 to be ground in any way limited to the strictly rectangular geometrical shape that is depicted again in FIG. 2*a*.

Figure 2:
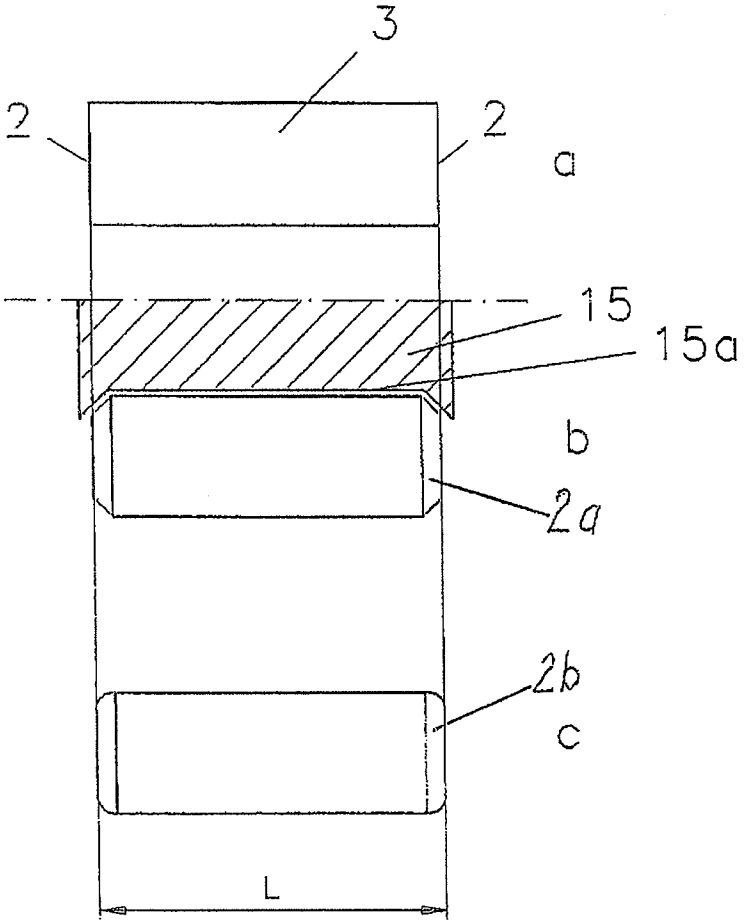
FIG. 2 depicts different longitudinal contours that the rod-shaped workpiece to be ground can have.

FIG. 2 depicts different variants of the longitudinal sides 3 of the rod-shaped workpiece 1. Thus planar bevels 2*a* (FIG. 2*b*) or roundings 2*b* (FIG. 2*c*) can also be present in the transition to the end faces 2. The strict rectangular shape can be varied to include a round shape (d). Furthermore, conical longitudinal contours (e) are possible, but also a basic rectangular shape with a sunken middle section (f).

Figure 3:
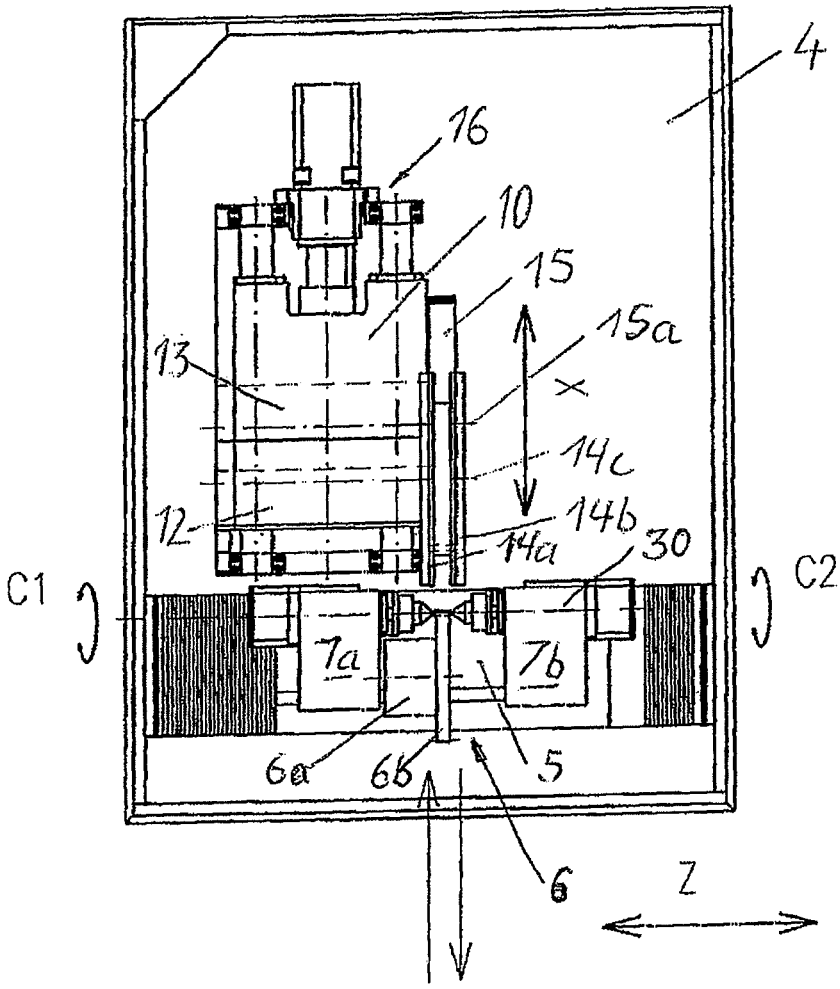
FIG. 3 is a view from above of an embodiment of a grinding machine for performing the inventive method.

FIG. 3 depicts the inventive embodiment of a grinding machine with which complete machining of the rod-shaped workpiece 1 is possible, starting from a blank. A grinding table having a slide track 5 is embodied on a machine bed 4. The holding device 6 can be moved in the direction of this slide track 5. This movability is in particular for adjusting the position of the holding device 6 for adapting to different workpieces 1 and their dimensions. In contrast to FIG. 3, it is also possible for the displacement movement of the grinding wheel 14, 15 with respect to the workpiece 1 to be arranged as a compound slide below the X axis on the machine bed 4 in the direction of the Z axis.

The holding device 6 preferably comprises a circular timing disk 6*b* that is arranged turnable about its center point in a plane perpendicular to the Z direction (i.e. the direction of the slide track 5). The timing disk 6*b* is connected by a base part 6*a* to the slide track 5 and is disposed substantially thereabove. In the vicinity of its circumferential area the timing disk 6*b* carries, arranged with equal angular spacing, a plurality of clamped positions 40 for receiving the workpieces 1, 1' to be machined. To this end the clamped positions 40 are embodied as loading grippers 24 that can securely clamp the exterior circumference of the workpiece 1 between two clamping jaws 24*a* or can release it by moving the clamping jaws 24*a* apart from one another. The shape of the clamping jaws 24*a* that are for the loading grippers 24 and that face the workpiece 1 preferably conforms to the exterior shape of the unmachined workpieces 1 so that they are securely fixed for grinding. Naturally the loading grippers 24 must be able to hold a machined workpiece 1 that has been finished securely and they must not interfere with the grinding wheels 14, 15 during machining.

Figure 4:
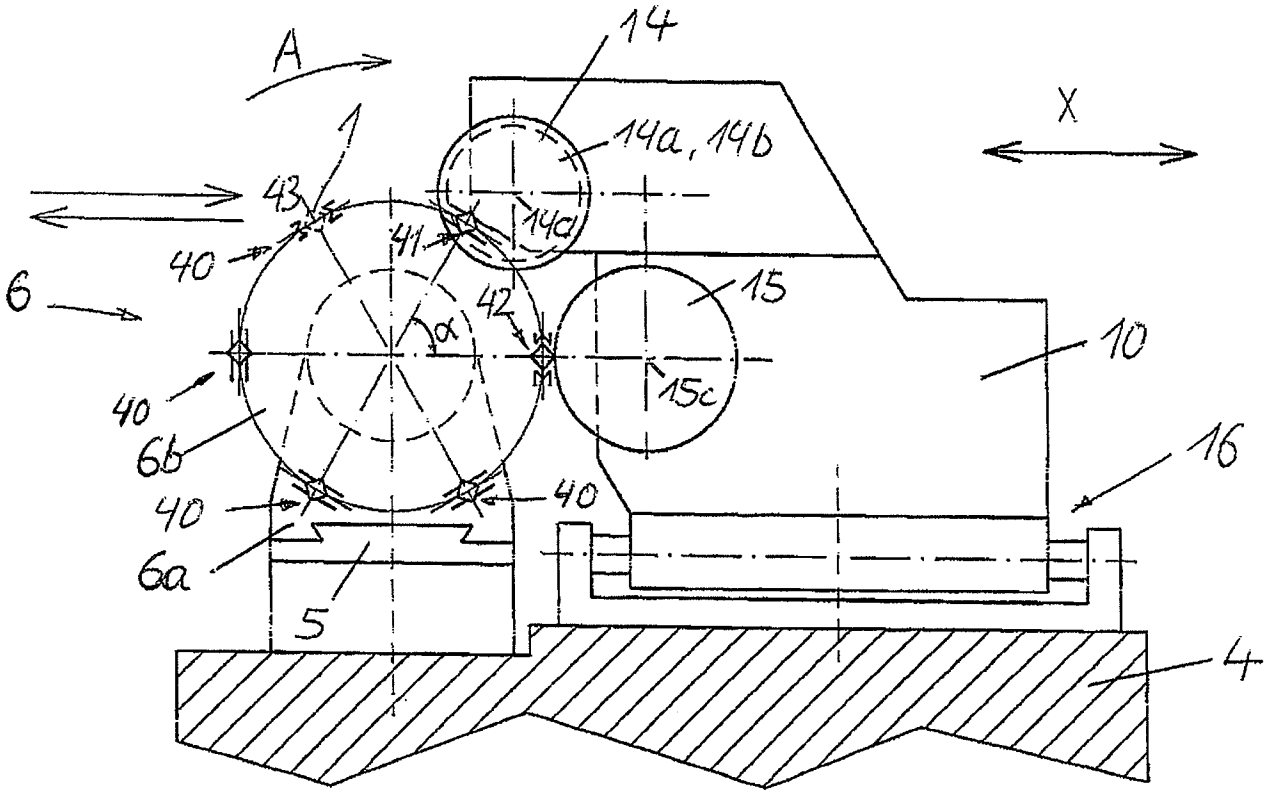
FIG. 4 depicts a schematic side view of an inventive grinding machine viewed from the height of the holding device in the Z direction.

The minimum number of clamped positions 40 is three, at least one (reference number 43) being used during operation for loading and unloading the workpieces 1 and each of the other two being disposed at one of the machining positions 41, 42 for the first and second grinding wheels 14, 15. However, preferably more than three clamped positions 40 are provided, as is depicted in FIG. 4, in which six of them are present. In this way it is also possible to separate the loading and unloading areas from one another. It is preferable, however, that the workpieces are loaded and unloaded at the same position 43, because this requires the least amount of space. Naturally, any loading and unloading devices can be used that are familiar to one skilled in the art. Regardless of the number of clamped positions 40, however, there are always at most two workpieces 1, 1' being machined, since in accordance with the invention only two grinding spindles 12, 13 are present; however, they can each be fitted with one or two grinding wheels 14, 14*a*, 14*b*, 15.

Disposed on both sides of the holding device 6 are the workpiece headstocks 7*a* and 7*b*, which can also be moved on the slide track 5. The workpiece headstocks 7*a*, 7*b* can be individually or jointly movable. Borne in the workpiece headstocks 7*a*, 7*b* are clamping jaws 8*a*, 8*b* that can be driven to rotate. A control is provided that is used to turn the two clamping jaws 8*a*, 8*b*, which are disposed coaxially at a distance from one another, synchronously and in phase.

Figure 7:
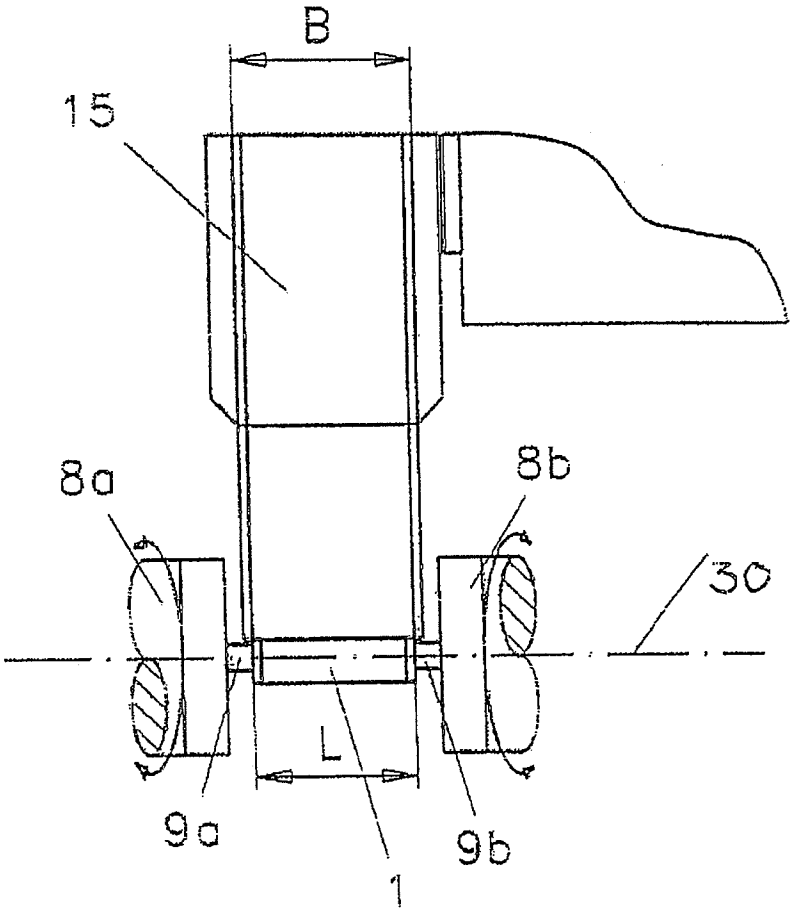
FIG. 7 is a detail of a second grinding wheel in contact with a workpiece clamped between rotating jaws.

On their outer ends the clamping jaws 8*a*, 8*b* each carry a friction layer 9*a*, 9*b* with which the clamping jaws 8*a*, 8*b* can be pressed against the end faces 2 of the rod-shaped workpiece 1 in order to clamp the latter; see also FIG. 7. The friction layers 9*a*, 9*b* on the clamping jaws 8*a*, 8*b* comprise a very wear-resistant material, for instance a hard metal, reducing their wear.

Exactly perpendicular to the grinding table with the slide track 5 and to the lateral displacement direction for the workpiece headstocks 7*a*, 7*b* and/or their clamping jaws 8*a*, 8*b* a grinding headstock 10 can be moved in the X direction, i.e. perpendicular to the slide track 5. The grinding headstock 10 carries two grinding spindles 12 and 13 that are arranged offset to one another in height and in terms of horizontal distance from the slide track 5, as depicted in FIG. 4. The first grinding spindle 12 carries two first grinding wheels 14*a*, 14*b*, while the second grinding spindle 13 is provided with the second grinding wheel 15. The grinding spindles 1 and 13 drive the associated grinding wheels 14*a, b* and 15 to rotate about their rotational axes 14*c* and 15*a*.

In the normal labeling of grinding equipment, the slide track 5 with the lateral displacement direction for the clamping station 6 and the workpiece headstocks 7*a*, 7*b* define the Z axis. The shared axis of rotation/drive axis 16 for the clamping jaws 8*a*, 8*b* form the axis of rotation C, while the X axis is the direction of displacement for the grinding headstock 10, which runs perpendicular to the Z axis and to the C axis.

Figure 6:
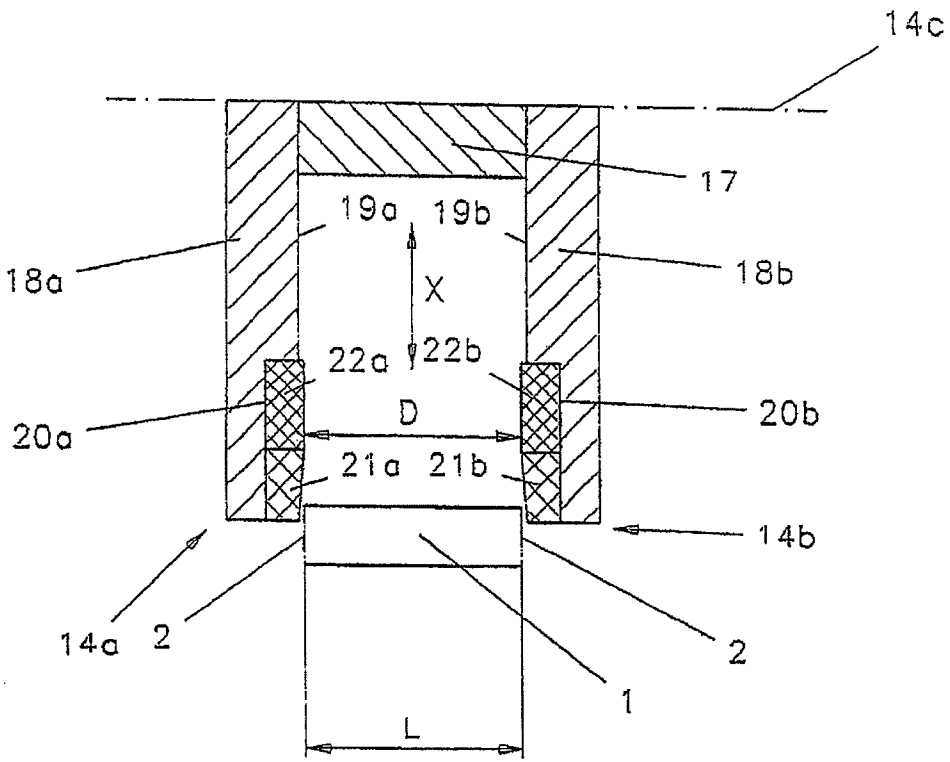
FIG. 6 depicts a partial cross-section through a double grinding wheel having a rough-cutting layer and a finish-cutting layer and through a workpiece to be machined.

Details of the first grinding wheel 14, the double grinding wheel 14, which is provided in a dual arrangement of two grinding wheels 14*a*, 14*b*, proceed from FIG. 6. The two grinding wheels 14*a*, 14*b* are arranged on the shared rotational axis 14*c* of the first grinding spindle 12 at an axial distance D that is defined by the spacing wheel 17. Each grinding wheel 14*a*, 14*b* comprises a base body 18*a*, 18*b*. In their exterior circumferential areas, each of the two wide sides 19*a*, 19*b* of the base bodies 18*a*, 18*b*, which face one another, has a recess 20*a*, 20*b* in which is disposed an exterior annular zone 21*a*, 21*b* having a rough-cutting layer and an interior annular zone 22*a*, 22*b* having a finish-cutting layer. The two layers 21*a*, 21*b* and 22*a*, 22*b* form annular bodies within the recesses 20*a*, 20*b*. The exterior annular zones 21*a*, 21*b* defined by the rough-cutting layer have a shape that expands conically outward. The grinding configuration of the double grinding wheel can be embodied in a single grinding wheel.

Figure 5A:
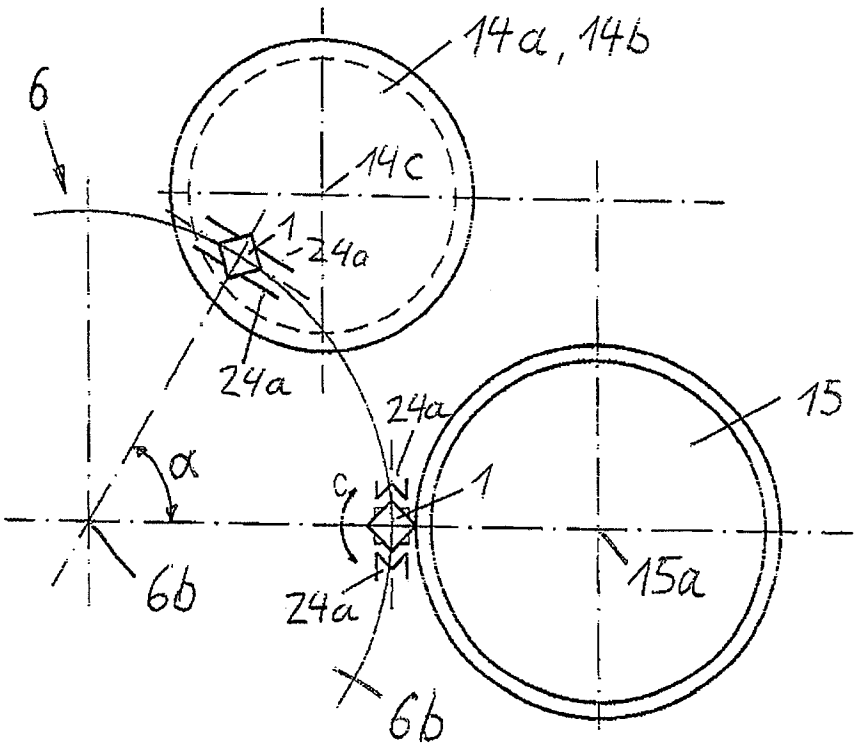
FIG. 5A depicts the relative position of the first and second grinding wheels and the machining position for each of two workpieces.

FIG. 5A clarifies the arrangement of the two grinding wheels 14, 15 and thus the axes for the associated grinding spindles 12, 13 with respect to one another and to the holding device 6 having the workpieces 1. This is a side view in the Z direction. At the point in time depicted, the first grinding wheel 14 has already concluded machining the end faces of the workpiece and has traveled in the X direction to a position in which the two abrasive layers of the double grinding wheel are no longer in contact with the workpiece 1. The workpiece 1, the exterior contour of which has not yet been machined, is still held by the loading gripper 24 for the clamped position.

The second grinding wheel 15 is just beginning to come into contact with another workpiece 1, the end faces 2 of which were finished by the first grinding wheel 14 in a previous cycle. The workpiece 1 is clamped in the longitudinal direction by clamping jaws 8*a*, 8*b* (not shown) and is caused to rotate synchronously in the C direction by the associated drives for the two headstocks 12, 13 (not shown). The clamping jaws 24*a* of the loading gripper 24 are released from the workpiece 1 after the workpiece 1 has been gripped and clamped by the clamping jaws 8*a*, 8*b*.

Figure 5B:
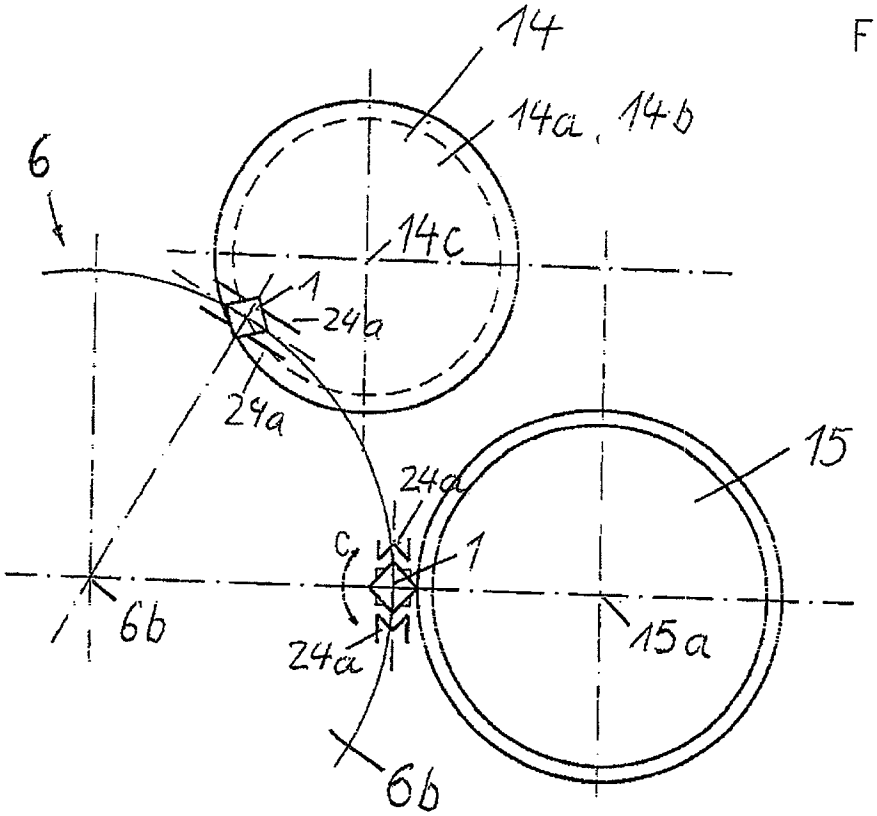
FIG. 5B depicts the relative position of the first and second grinding wheels and the machining position for each of two workpieces, both grinding wheels being at least partly concurrently in contact with the workpiece.

FIG. 5B depicts a variant in which the first grinding wheel 14 is still in machining contact with the end faces 2 of the one workpiece 1, while the second grinding wheel 15 is just beginning to grind the exterior contour. Thus, in such an arrangement, which is substantially based on a smaller horizontal distance between the two axes of the grinding spindles 12, 13, the two different workpieces 2 are machined at least partly at the same time. This leads to a further reduction in the cycle time and thus to increased productivity.

In the holding device 6, at each clamped position 40 two clamping jaws 24*a* for a loading gripper 24 are arranged diametrically opposite one another and are controlled such that they can be moved relative to one another. The clamping jaws 24*a* of the loading grippers 24 conform to the cross-section of the rod-shaped workpiece 1. In the loading position 43 in FIG. 4, the clamping jaws 24*a* of the loading gripper 24 have been moved apart from one another. In position 41, the clamping jaws of the loading gripper 24 have gripped the rod-shaped workpiece 1 and are positioned against it in a mutually compensating manner. This type of gripping and clamping has the advantage that when gripping and clamping the rod-shaped workpiece 1, its longitudinal center always remains in the same horizontal plane, even given different grinding amounts for the workpieces 1. Thus, in contrast to a rigid workpiece support, the grinding amount does not have any effect on the position of the center of the workpiece. During later circumferential grinding the amount is removed uniformly. As position 41 in FIG. 4 illustrates, the holding device 6 can move the clamped rod-shaped workpiece 1 right up to the first grinding wheels 14*a*, 14*b* in the double grinding wheels.

The following describes in detail the sequence of a grinding process on a grinding machine in accordance with FIG. 4.

The blank for the rod-shaped workpiece 1 is transferred from a conventional transport system to the loading position 43 in the holding device 6 on a clamping device. There, as already described, the workpiece 1 is clamped, centered, by means of the clamping jaws 24*a* for the loading gripper 24; see position 41 in FIG. 4. The holding device 6 then turns about the angle α and guides the workpiece 1 into the active area of the first grinding wheel 14. The two end faces 2 on the rod-shaped workpiece 1 undergo concurrent double face grinding in this first clamped position, which can be seen in FIG. 4, in the first machining position. To this end, the grinding headstock 10 advances toward the rod-shaped workpiece 1 in the direction of the X axis; see FIG. 4. The exterior annular zones 21*a*, 21*b* with the rough-cutting layer (see FIG. 6) each grind one end face 2 of the rod-shaped workpiece 1. Then the interior annular zones 22*a*, 22*b* with the finish-cutting layer each pass over one end face 2 so that the end faces 2 are finish-ground.

Then the grinding headstock travels farther in the X direction so that the second grinding wheel 15 comes into contact with the surface of another workpiece 1, which is held in an appropriate machining position by the two workpiece headstocks 7*a*, 7*b*. Once the surface machining of this workpiece 1 has concluded, the grinding headstock 10 then returns to its starting position in the direction of the X axis, so that none of the grinding wheels 14, 15 are in contact with workpieces 1. At this point the timing disk 6*b* of the holding device 6 continues to turn about the angle α, which is determined by the number of clamped positions, and a new work cycle beings. This beginning is comprised in that a yet unmachined workpiece 1 is moved into the machining area of the first grinding spindle 12 and a workpiece 1 at this position that has already been finish-ground on its end faces 2 is conveyed to the machining area of the second grinding wheel 15. The rod-shaped workpiece 1 is then disposed in the area of the common axis of rotation/drive axis 16 for the two clamping jaws 8*a*, 8*b*. There this part is gripped and clamped when the clamping jaws are moved towards one another, whereupon the loading grippers 24 release the workpiece. Then a new grinding cycle begins in that the grinding table is moved in the X direction toward the holding device, thus positioning the grinding wheels against the workpieces 1. Face grinding can even occur during the re-clamping. This further reduces the cycle time, because planar grinding is occurring in the first machining position 41 during the re-clamping.

In the machining area 42 of the second grinding spindle 13, the two workpiece headstocks 7*a*, 7*b* advance toward the rod-shaped workpiece 1 until the friction layers 9*a*, 9*b* of the clamping jaws 8*a*, 8*b* have clamped the end faces 2 of the rod-shaped workpiece 1. Depending on the embodiment of the workpiece headstocks 7*a*, 7*b*, however, the end faces 2 of the rod-shaped workpiece 1 can be clamped only using the clamping jaws 8*a*, 8*b* if the latter are not only rotatably driveable, but can also be moved axially. Then the loading grippers 24 of the clamping station 6 are moved apart from one another.

The advantage of this type of re-clamping is that the workpiece 1 no longer has to be gripped separately with one loading handling between the two machinings. Because of this, optimum accuracy can be attained for the clamping between the clamping jaws 8*a*, 8*b*, because no further positioning errors can occur from loading handling. The clamping jaws 8*a*, 8*b* performing the movements and the clamping forces of the loading grippers 24 ensure that the workpiece 1 is not displaced longitudinally during the re-clamping.

Not only is the rod-shaped workpiece 1 clamped in its second clamped position by the two clamping jaws 8*a*, 8*b*, but it is also driven to rotate in a controlled manner by the two clamping jaws 8*a*, 8*b*, the common axis of rotation/drive axis 16 for the two clamping jaws 8*a*, 8*b* forming the C axis of the grinding process. Naturally the clamping jaws 8*a*, 8*b* cannot turn the rod-shaped workpiece 1 until it is disposed outside of the loading grippers 24 and the first clamped position is thus released. In addition, FIG. 7 illustrates how the second grinding wheel 15 is advanced and positioned in the direction of the X axis at the circumference of the rod-shaped workpiece 1.

FIG. 7 depicts circumferential grinding in the second clamped position from above, the clamping jaws 8*a*, 8*b* clamping and simultaneously turning the rod-shaped workpiece 1.

The common axis of rotation/drive axis 16 forms the C axis for the grinding process. The axial width B of the second grinding wheel 15 covers the length L of the rod-shaped workpiece 1.

Circumferential grinding using the C-X interpolation principle is performed, each turning position of the rod-shaped workpiece 1 equaling a certain distance between the C axis and the rotational axis 15*a* of the second grinding wheel in the direction of the X axis. This process is familiar in principle to one skilled in the art from known CNC non-circular grinding and need not be explained in greater detail here. As can be seen, the cross-sections depicted in FIG. 1 and similar cross-sections can be created using this principle The mutual movement by the workpiece 1 and the second grinding wheel 15 is produced by moving the grinding headstock 10 in the direction of the X axis. Rough-grinding and finish-grinding can be performed using a single second grinding wheel 15.

The different longitudinal contours depicted in FIG. 2 can be created in that the circumferential contour 15*a* of the second grinding wheel 15 is appropriately profiled; see FIG. 2*d*. In particular end-face bevels 2*a* or roundings 2*b* can be ground on the rod-shaped workpiece 1 in one contour pass and in the same clamping concurrent with the grinding of the longitudinal sides 3. The circumferential contour 15*a* of the second grinding wheel 15 must be appropriately shaped for this; see FIG. 2*b*.

As can be seen, the holding device 6 satisfies different tasks while the inventive method is being performed. Initially it is a transport device and delivers rod-shaped workpieces 1 to the active area of the first grinding wheels 14*a*, 14*b* in the double grinding wheel 14. There it is also a clamping device that provides the first clamped position for the rod-shaped workpiece 1 while its end faces are being ground. Then the clamping station 6 again acts as a delivery means that transfers the rod-shaped workpiece 1 to the area of the two clamping jaws 8*a*, 8*b* corresponding to position 4 in FIG. 4. Then the clamping jaws 8*a*, 8*b* take over the clamping into the second clamped position for performing the circumferential grinding. The holding device 6 transports the finish-ground workpiece on to an unloading position, from which position the workpiece can be removed by an unloading device (not shown). The clamped position that has become free in this manner can now take on a new workpiece blank, which preferably occurs by means of a loading device arranged in the vicinity of a discrete loading position 43.

Figure 9:
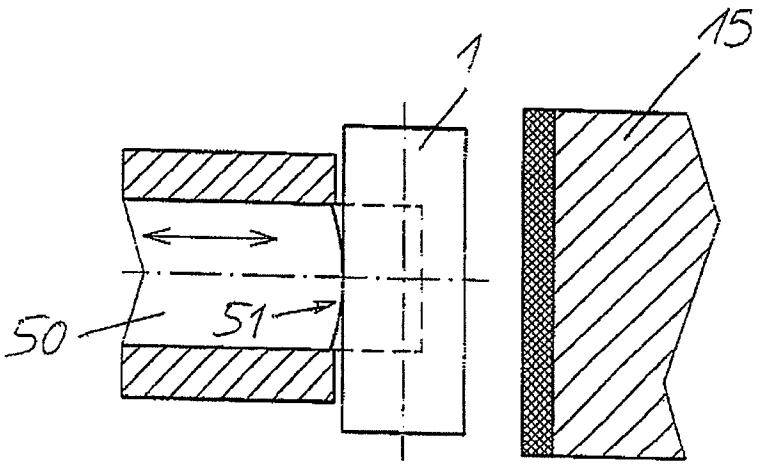
FIG. 9 is a top view of the arrangement in accordance with FIG. 8, in section.
Figure 8:
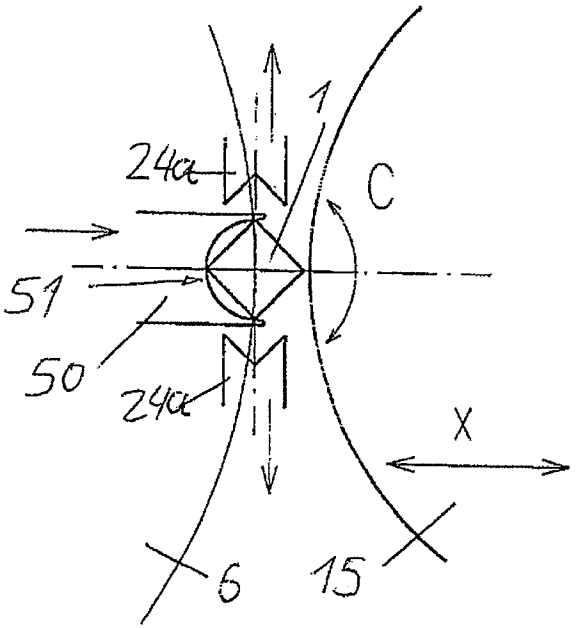
FIG. 8 is a detail of a workpiece in position for machining the exterior contour, supported by means of a steady.

FIGS. 8 and 9 depict another embodiment of the invention in which the individual clamped positions 40 for the holding device 6 are provided with steadies 50 as devices for supporting the workpiece 1 during machining of the exterior contour by means of the second grinding wheel 15. To this end provided on the timing disk 6*b* of the holding device 6 is a component that can be displaced in the radial direction and that, when the gripping surfaces of the loading gripper 24 are moved apart from one another, can be placed against the workpiece 1 that is held and rotationally driven by the clamping jaws 8*a*, 8*b*. On its front side facing the workpiece, this component has a largely semi-circular recess 51 that conforms to the dimensions of the workpiece 1, as can be seen in the side view in accordance with FIG. 8. Dimensioning the recess 51 and the shape of the interior contour makes it possible for the workpiece 1 to be securely supported at at least one point of its exterior contour at all times during rotation about its longitudinal axis in the C direction, at least in the center area. This prevents the workpiece 1 from being bent by the grinding pressure so that particularly good grinding accuracy and high cutting volume can be attained.

FIG. 9 is a top view of the arrangement in accordance with FIG. 8, which depicts a cross-section through the component acting as the steady 50. In this figure it can be seen that the interior contour of the component is a curve so that essentially only point-contact or line-contact is possible with the center area of the workpiece 1. This results in minimum limitation to the rotation of the workpiece 1 and to reducing the risk of scoring or other damage on the workpiece. The reference numbers in FIGS. 8 and 9 are the same as in the other figures.

The inventive steadies are moved against the workpiece 1 or removed from it by actuating devices that are not shown in FIGS. 8 and 9 and that are controlled hydraulically, pneumatically, or by electrical devices. The necessary movements by the steady 50 result from the requirements for the method being used.

The circumferential grinding described here offers a particular advantage when the rod-shaped workpiece 1 has a structure that is transversely layered, as is valuable for many applications. Thus, alternating, securely joined layers of different materials can be provided in the workpiece 1. In contrast to longitudinal face grinding, during circumferential grinding the materials of the individual layers are not mixed in with one another in the area of the lateral surfaces.

Figure 10:
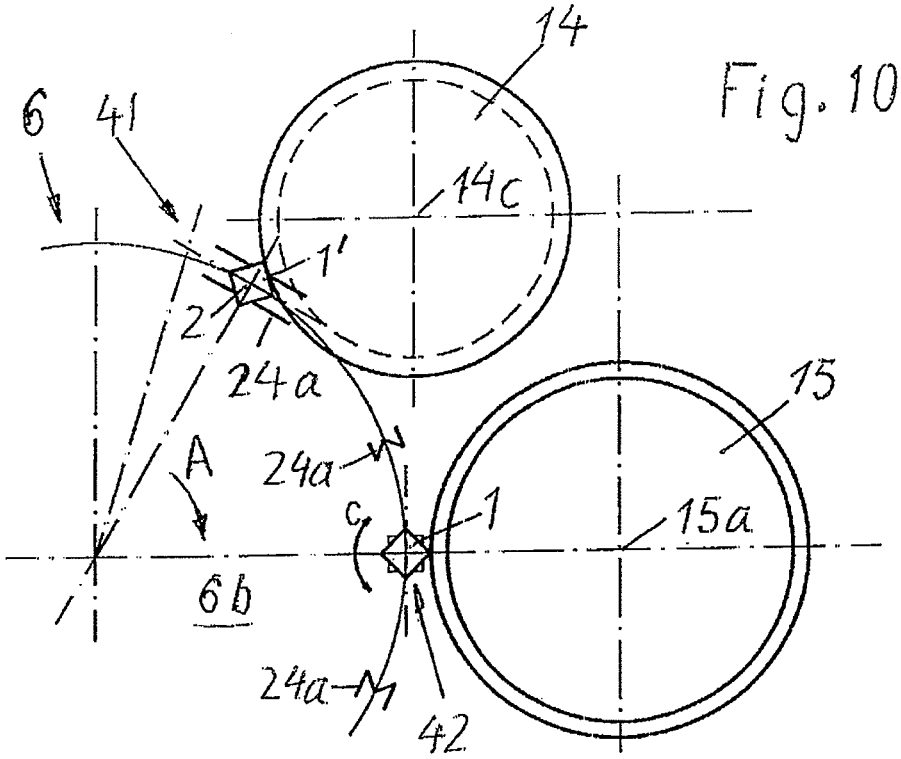
FIG. 10 depicts a first phase of the nearly concurrent machining of two workpieces.
Figure 11:
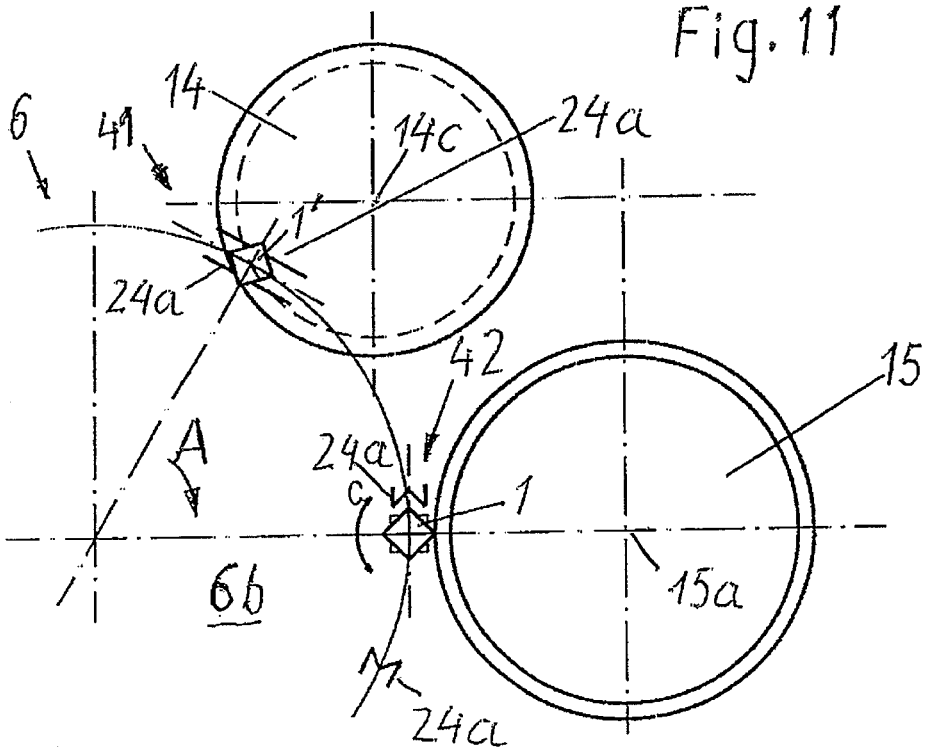
FIG. 11 depicts another phase of the method guidance in accordance with FIG. 10.

FIG. 10 depicts a first phase of the inventive method in which the end faces of the workpiece 1, 1' are double face ground by moving the holding device 6. Using this embodiment of the method it is possible to machine two workpieces 1 and 1' substantially concurrently. To this end the holding device 6 for the workpieces 1, 1', which is embodied as a timing disk 6*b*, is actuated and operated such that it is turned both in the forward direction, i.e. direction A in FIG. 4, and also intermittently in the backward direction. FIG. 10 depicts one condition in the method in which a first workpiece 1 is in the second machining position 42 and, held by clamping jaws 8*a*, 8*b* (not shown) (see FIG. 7), is ground on its circumference by the second grinding wheel 15. The clamping jaws 24*a* that have held the workpiece for transport and for double face grinding the end faces have been moved far apart from one another. Consequently there is no more contact with the timing disk 6*b*, since the aforesaid clamping jaws 8*a*, 8*b*, which clamp the first workpiece 1 in the second machining position 42 in the longitudinal direction and rotate according to the arrow C, are arranged independent of the timing disk 6*b*. When turning, the opened clamping jaws 24*a* also do not interfere with second grinding wheel 15 when the timing disk 6*b* carrying them rotates in a limited angular area. The timing disk 6*b* is thus freely movable while the circumference of the first workpiece 1 is ground by the grinding wheel 15. Another workpiece 1' is securely clamped on the timing disk 6*b* by means of the associated clamping jaws 24*b* and is disposed just prior to contact with the first grinding wheel 14, by means of which the two end faces 2 are to be face ground. This occurs in that the timing disk 6*b* is turned forwards until the condition depicted in FIG. 11 is attained, in which the other workpiece 1' is finish-ground on the end faces. Now the timing disk

6*b* is turned backwards until the first workpiece finish-ground in the second machining position 42 can again be gripped by the clamping jaws 24*a*. This essentially corresponds to the condition depicted in FIG. 10. After this gripping, the other clamping jaws in the second machining position 42 are released and the workpiece 1, now completely finish-ground, can be moved by the timing disk 6*b* to the unloading position 43 (not shown) (see FIG. 4), which occurs by turning the timing disk 6*b* in the forward direction A. The other workpiece 1' is moved from the first machining position 41 to the second machining position 42, where it is positioned itself for final machining by non-circular grinding of the circumferential surfaces. At the same time another workpiece 1 or 1' advances from the loading position 43 (not shown) into the first machining position 41, where it is ready for its two end faces 2 to be machined by means of the double grinding wheel 14. The process is performed successively for all of the workpieces to be machined.

In the method described, the additional workpiece 1' necessarily passes through the active area of the first grinding wheel 14 several times. The first time relatively slowly in the forward direction A for double face grinding of the two end faces 2 and then back once to bring the timing disk 6*b* to the transfer position for the finish-ground first workpiece 1 and then forward again to transfer the additional workpiece 1' that has been finish-ground on its end faces 2 to the second machining position 42. In the two latter phases of the movement, which can occur relatively rapidly as pure transport steps, the first grinding wheel 14 has essentially no more grinding action on the workpiece 1' because the latter has already been finish-ground. Alternatively, the grinding headstock 10 can be moved away from the grinding position in the X direction (see FIG. 4) for the brief period that the timing disk 6*b* turns backwards and turns forwards again until the grinding wheels are outside of the movement path for the workpieces. This precludes any negative effect on the workpiece 1 during transport.

Because with this variant of the method both grinding wheels 14 and 15 each machine a workpiece 1, 1' concurrently, a significant amount of time is won compared to the aforesaid prior art and also compared to the method usage explained in the foregoing using FIGS. 5A and 5B, in which only the grinding wheels are positioned on the workpiece. This time is gained in particular because neither of the grinding wheels 14 and 15 has any idle time caused by waiting for the other grinding wheel to perform finish-grinding. Both grinding wheels are practically continuously in use except for relatively brief periods of transporting and re-clamping workpieces.

It is understood that the lateral and vertical spacing of the axes for the grinding spindles 14*c* and 15*a* in the tandem arrangement on the associated grinding headstock 10 in this method usage must be adapted to the particular requirements. Thus the two axes 14*c* and 15*a* in this case must move closer together than in the other variant of the method according to FIGS. 5A and 5B, in which only the grinding spindles are positioned for grinding, while the transport device 6 for the workpieces 1, in this case the timing disk 6*b*, is not moved in the sense of positioning. The distance between the axes should be selected such that when one workpiece 1 is transferred into the clamping jaws of the second clamped position, another workpiece 1' in the first clamped position does not yet move into contact with the first grinding wheel 14, as can be seen in FIG. 10.

The invention claimed is:

1. Grinding machine for grinding rod-shaped workpieces having a non-circular cross-section formed by at least one of straight and curved lines and flat end faces that run parallel to one another, comprising:

a machine bed supporting a slide track on which are arranged on a common axis C two workpiece headstocks adjustably axially spaced from each other;

wherein the workpiece headstocks comprise respective clamping jaws having respective clamping surfaces facing one another; and each workpiece headstock further comprises an electric motor for rotating a respective one of the clamping jaws about the C-axis;

a control device configured to cause the two clamping jaws to rotate synchronously and in-phase and to clamp the workpiece by moving against the end faces of the workpiece;

a grinding headstock arranged on the machine bed such that it can be moved in a controlled manner along an X axis perpendicular to the C axis;

a first grinding wheels or wheel and a second grinding wheel carried by the grinding headstock, rotationally driven first and second grinding parallel spindles on which are respectively mounted the first grinding wheels or wheel and the second grinding wheel, the grinding wheels being arranged above one another such that the first grinding wheels or wheel is higher and closer to a perpendicular plane of symmetry of the slide track than the second grinding wheel;

wherein the first grinding wheels or wheel defines a space laterally bounded by opposed walls surfaced with abrasive layers spaced apart by distances substantially equal to length of the workpiece for grinding the end faces of the workpiece;

and wherein axial width of the second grinding is at least equal to length of the workpiece for grinding longitudinal sides of the workpiece;

a holding device arranged between the workpiece headstocks, mounted for being rotationally driven about an axis parallel to axes of the spindles and carrying at least three angularly spaced pairs of grippers;

wherein each pair of grippers is configured for clamping the workpiece on its longitudinal sides and for bringing it with a longitudinal axis thereof parallel to the C axis into a first machining position for grinding the end faces thereof concurrently by said opposed walls surfaced with said abrasive layers and for subsequently transferring the workpiece to a second machining position at which the workpiece is clamped by the clamping jaws;

wherein the second grinding wheel is located in the second machining position and the control device is also configured to effect grinding of the longitudinal sides of the workpiece by controlling rotation of the workpiece about the C axis and movement of the second grinding wheel in a direction along the X axis.

2. Grinding machine in accordance with claim 1, wherein circumferential contour of the second grinding wheel for contacting the length of the workpiece is non-cylindrical and corresponds to longitudinal contour of the finish-ground workpiece.

3. Grinding machine in accordance with claim 2, wherein the circumferential contour of the second grinding wheel is also shaped to correspond to shape of an end-face bevel or end-face rounding that is to be ground on the workpiece.

4. Grinding machine in accordance with claim 1, wherein each of the clamping jaws is provided with a friction layer for contacting an end face of the workpiece.

5. Grinding machine in accordance with claim 1, wherein the abrasive layers comprise a first zone wherein the abrasive layer is a rough-cutting layer and a second zone radially inward from the first zone and wherein the abrasive layer is a finish-cutting layer and the distance between the opposed walls surfaced with the abrasive layers increases in the first zone toward periphery of the first grinding wheels or wheel.

6. Grinding machine in accordance with claim 1, wherein each pair of grippers conforms to the cross-section of the workpiece.

7. Grinding machine in accordance with claim 1, wherein the holding device comprises a timing disk drivingly rotated about an axis of rotation in both directions.

8. Method for grinding rod-shaped workpieces having longitudinal sides, a non-circular cross-section formed by at least one of straight or curved lines and flat end faces that run parallel to one another in accordance with the grinding machine of claim 1, comprising the following steps:

a) positioning the workpiece at a holding device that has a plurality of first clamping positions and clamping the workpiece on its longitudinal sides in a first clamping position;

b) moving the clamped workpiece into a first machining position by means of the holding device;

c) finish grinding the end faces of the workpiece concurrently in the first machining position by double face grinding;

d) moving the clamped rod-shaped workpiece by means of the holding device to a second machining position between two coaxial clamping jaws that are spaced apart from one another and clamping the workpiece on the finish ground end faces thereof in a second clamping by means of the clamping jaws, and thereupon releasing the first clamping;

e) synchronously driving the clamping jaws about the axis C and finish grinding the longitudinal sides of the rotating workpiece in the second machining position by circumferential grinding with a grinding wheel driven about a second axis of rotation parallel to the C axis, the grinding wheel moving in a direction along an axis X perpendicular to the C axis;

f) releasing the second clamping of the workpiece by moving the clamping jaws apart from one another; and g) moving the workpiece by means of the holding device into an unloading position.

9. Method in accordance with claim 8, wherein the double face grinding comprises:

positioning the workpiece clamped on longitudinal sides thereof in the first machining position with a longitudinal axis of the workpiece parallel to an axis about which coaxial first grinding wheels having mutually opposed lateral faces formed by respective abrasive layers spaced apart from one another by distances substantially corresponding to length of the workpiece are rotationally driven or a single first grinding wheel having mutually opposed lateral faces formed by respective abrasive layers spaced apart from one another by said distances is rotationally driven;

moving relative to each other the rotationally driven first grinding wheels or wheel and the holding device with the workpiece clamped on longitudinal sides thereof in a direction of the X axis; and thereby grinding the end faces of the workpiece by contact thereof which said abrasive layers.

10. Method in accordance with claim 9, wherein the peripheral grinding comprises rotationally driving a second grinding wheel about an axis parallel to the C axis and to the axis of rotation of the first grinding wheels or wheel and the first and second grinding wheels are arranged laterally and vertically offset on a shared grinding headstock, the upper, first grinding wheels or wheel being disposed in front of the second grinding wheel relative to direction of the movement of the holding device.

11. Method in accordance with claim 8, wherein respective said workpieces are present both in the first machining position and in the second machining position concurrently and the two workpieces are ground concurrently, at least intermittently.

12. Method in accordance with claim 8, wherein the clamping of the workpiece in the first clamping position comprises gripping the workpiece with at least two grippers-disposed on the holding device, conforming to the cross-section of the workpiece and opposing one another on an axis perpendicular to the longitudinal axis of the workpiece.

13. Method in accordance with claim 12, wherein the movement of the holding device is by rotation thereof and the plurality of clamping positions comprises a plurality of pairs of the grippers disposed on the holding device at angularly spaced locations.

14. Method in accordance with claim 8, wherein the peripheral grinding comprises:

grinding all lateral edges of the workpiece to their finished dimensions;

positioning against the workpiece a steady having a substantially semi-circular recess for receiving the workpiece;

grinding all lateral faces of the workpiece with the steady positioned against the workpiece, until the final dimensions are attained; and then removing the steady from the workpiece.

15. Method in accordance with claim 14 further comprising, after removing the steady from the workpiece, finish grinding the workpiece.

16. Method according to claim 8, wherein the peripheral grinding is CNC-controlled.

17. Grinding machine for complete machining of workpieces having longitudinal sides and circular or non-circular cross-sections, comprising;

first grinding wheels comprising opposing main bodies defining grinding layers that face one another for concurrently grinding outermost end faces of the workpieces upon receipt of the end faces therebetween the grinding layers, a second grinding wheel for grinding the longitudinal sides of the workpieces, a holding device for holding and moving the workpieces to the first grinding wheels and the second grinding wheel in succession, a grinding headstock that is controllable so as to be movable along an axis that is perpendicular to the workpieces held by the holding device, and first and second parallel spindles carried by the grinding headstock so that said spindles are spaced vertically relative to each other and on which the first grinding wheels and the second grinding wheel are respectively mounted to be rotationally driven, the first grinding wheels and the second grinding wheel being offset from one another so that the workpieces are moved by the holding device to the first grinding wheels or before the second grinding wheel so that the first grinding wheels come into grinding contact with the end faces of a first workpiece as the second wheel is positioned into grinding contact with the longitudinal sides of a second workpiece in succession.

18. Grinding machine in accordance with claim 17, wherein the holding device comprises a timing disk in which the workpieces are held angularly spaced apart from one another on the circumference of the disk at respective first clamping positions comprising respective gripper sets and are moved to the grinding wheels by rotating the timing disk.

19. Grinding machine in accordance with claim 17, wherein the first grinding wheels and the second grinding wheel are spaced apart from one another and arranged relative to one another such that the first grinding wheels has concluded its grinding operation before the second grinding wheel begins its grinding operation.

20. Grinding machine in accordance with claim 17, wherein the first grinding wheels and the second grinding wheel are spaced apart from one another and arranged relative to one another such that at least during one period of time both the first grinding wheels and also the second grinding wheel perform their grinding operations on respective ones of the workpieces concurrently.

21. Grinding machine in accordance with claim 17, wherein a distance between respective axes of the first and second spindles is adjustable.

22. Grinding machine in accordance with claim 17, wherein a width of a circumferential face of the second grinding wheel is at least as great as length of the workpiece.

23. Grinding machine in accordance with claim 17, wherein the first grinding wheel comprises a radial cross-section including a space between said facing grinding layers for receiving the workpiece for grinding contact of the end faces of a respective workpiece.

24. Grinding machine for complete machining of workpieces having longitudinal sides and circular or non-circular cross-sections, comprising first grinding wheels or wheel for concurrently grinding end faces of the workpieces, a second grinding wheel for grinding the longitudinal sides of the workpieces, a holding device for moving the workpieces to the first grinding wheels and the second grinding wheel, a grinding headstock, and first and second parallel spindles carried by the headstock and on which the first grinding wheel or wheels and the second grinding wheel are respectively mounted to be rotationally driven, the first grinding wheels or wheel and the second grinding wheel being offset from one another so that the workpieces are moved by the holding device to the first grinding wheels or wheel before the second grinding wheel and the first and second grinding wheels and the holding device being movable relative to each other along an axis X perpendicular to axes of the spindles, the holding device comprising a timing disk in which the workpieces are held angularly spaced apart from one another on the circumference of the disk at respective first clamping positions comprising respective gripper sets and are moved to the grinding wheels by rotating the timing disk, and each of the first clamping positions further comprising a steady configured for positioning against the workpieces during grinding of the workpieces by the second grinding wheel.

25. Grinding machine in accordance with claim 24, wherein each of the steadies has a recess of substantially semi-circular cross-section receiving and contacting the workpieces.

26. Grinding machine in accordance with claim 25, further comprising an electrical, hydraulic or pneumatic drive for positioning the steadies against and away from the workpieces.

* * * * *